US005525080A

United States Patent [19]

Calder et al.

[11] Patent Number: 5,525,080

[45] Date of Patent: Jun. 11, 1996

[54] CIRCUIT BREAKER TERMINAL SCREW ASSEMBLY

[75] Inventors: William H. Calder, Plainville; Rebecca C. Drumbor, Farmington, both of Conn.

[73] Assignee: General Electric Company, New York, N.Y.

[21] Appl. No.: 305,539

[22] Filed: Sep. 14, 1994

[51] Int. Cl.[6] ..... H01R 4/34; H01R 9/24

[52] U.S. Cl. ..... 439/709; 439/801

[58] Field of Search ..... 439/709, 801, 439/883

[56] References Cited

U.S. PATENT DOCUMENTS

| | | | |
|---|---|---|---|
| 2,581,181 | 1/1950 | Favre | 24/273 |
| 4,001,742 | 1/1977 | Jencks | 335/173 |
| 4,085,989 | 4/1978 | McCardell | 439/801 |
| 4,136,924 | 1/1979 | Dobrosielski | 439/801 |
| 4,174,147 | 11/1979 | Waddington et al. | 439/801 |
| 4,273,408 | 6/1981 | Orr | 439/709 |
| 4,680,672 | 7/1987 | May | 361/634 |
| 4,743,715 | 5/1988 | Gaillard | 200/50 AA |
| 4,801,907 | 1/1989 | Kelaita | 335/20 |
| 5,005,104 | 4/1991 | Grunert | 439/810 |

*Primary Examiner*- Gary F. Paumen
*Attorney, Agent, or Firm*- Richard A. Menelly

[57] ABSTRACT

A terminal screw assembly is attached to a high ampere-rated circuit breaker for connection between the internal electrical components and remote accessories, relays alarms and the like. A modular three-component metal connector arrangement provides electrical connection between one internal component and one remote accessory. A multichamber plastic terminal housing receives the connector arrangement and provides electrical isolation to each of the connectors within each arrangement.

15 Claims, 4 Drawing Sheets

CIRCUIT BREAKER TERMINAL SCREW ASSEMBLY

BACKGROUND OF THE INVENTION

High ampere-rated circuit breakers such as described within U.S. Pat. No. 4,001,742 entitled "Circuit Breaker Having Improved Operating Mechanism" are capable of interrupting several thousand amperes of circuit current at several hundred volts potential. Electrical terminals are used with such circuit breakers for connection with remote accessories for indication and control purposes. To facilitate connection with the connectors on the terminals, the insulative terminal assemblies are generally attached to the front part the circuit breaker case. U.S. Pat. Nos. 4,680,672 and 4,743,715 each describe the attachment of terminal assemblies attached to the front part of the circuit breaker case.

The insulative assemblies are provided with threaded metal plates that are arranged in rows on a front part thereof. Connection between the internal components and the remote accessories is made by attachment of planar type connectors on the ends of insulated wire conductors. A common or ring type terminal screw is inserted through the spade type connectors and is threaded within one of the metal plates to secure the connectors together and to the assembly.

It would be economically advantageous to form the insulative terminal assemblies from a molding or extrusion process without having to insert the metal plate connectors. Accordingly, one purpose of the invention is to provide insulative terminal assemblies without metal plates and using the structure of the connectors per se to mechanically attach the connectors to each other as well as to the assemblies.

SUMMARY OF THE INVENTION

Electrical terminal assemblies are formed to an array of compartments that include a slotted opening within each compartment. A spade type slotted terminal connector is attached to the end of one wire conductor and a planar terminal connector having a threaded opening is attached to the end of another wire conductor. The planar connector is press-fit within the slotted opening with the threaded opening facing upward. The common spade or ring slotted terminal connector is attached to the planar connector by the insertion of a terminal screw through the slot and into the threaded opening.

DESCRIPTION OF THE PREFERRED EMBODIMENT

Figure 1:
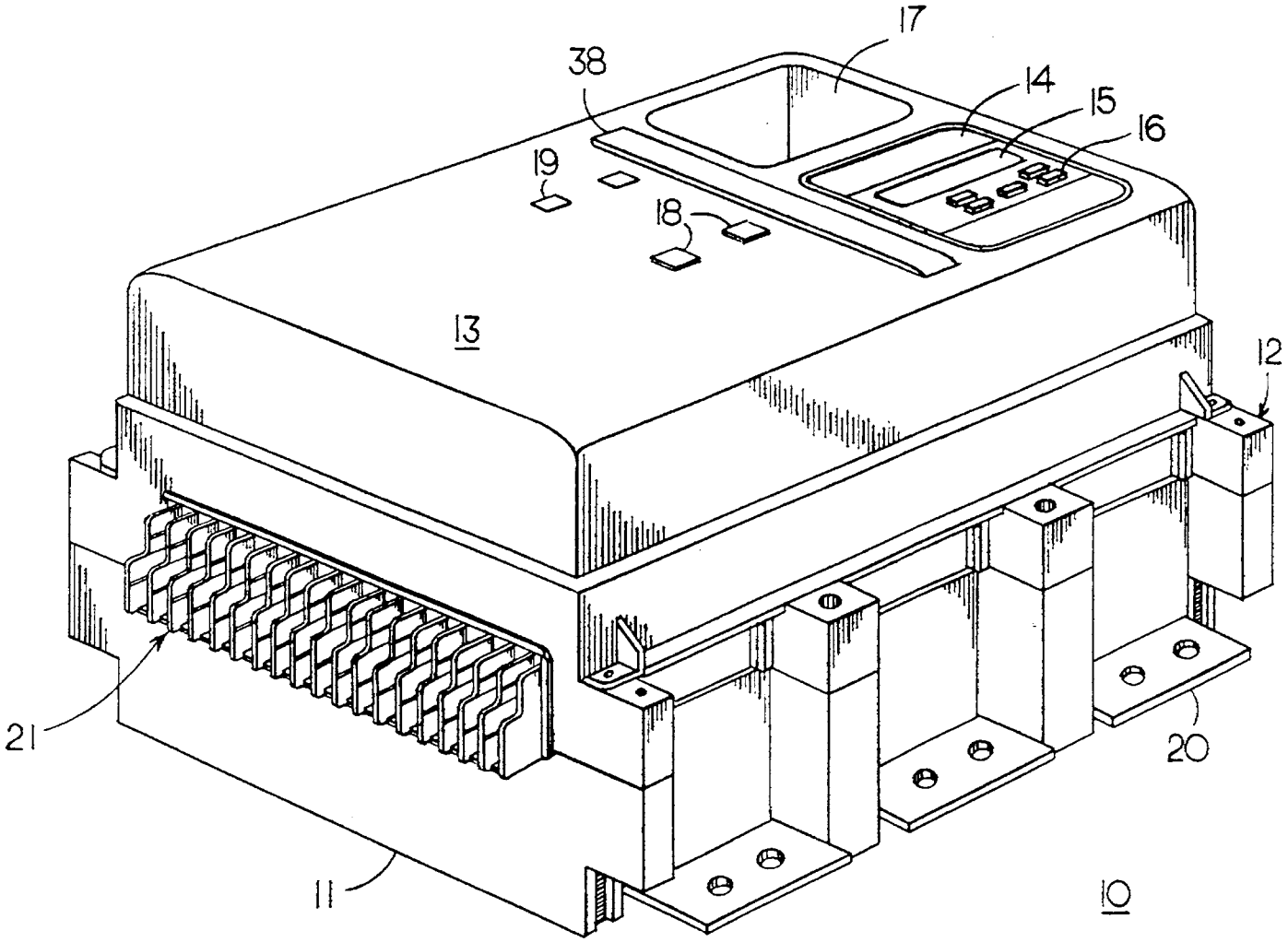
FIG. 1 is a top perspective view of a high ampere-rated circuit breaker employing the terminal screw assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior primary current-carrying components is made by load terminal straps 20 extending from one side of the base and line terminal straps (not shown) extending from the opposite side thereof. The interior components are controlled by an electronic trip unit 14 contained within the top cover 13 and which includes a display 15 and a keypad 16. Although not shown herein, the trip unit is similar to that described within U.S. Pat. No. 2,581,181 and interacts further with an accessory contained within the accessory recess 17 to provide a range of protection and control functions such as described, for example within U.S. Pat. No. 4,801,907. The operating handle 38 allows manual operation of the circuit breaker operating mechanism to open and close the circuit breaker contacts. The contacts can be automatically opened and closed by means of the buttons 18 and the state of the contacts is indicated on the indicator flag 19. In accordance with the teachings of the invention, a terminal screw assembly 21 is attached to the junction between the base 11 and the intermediate cover 12 for electrical access to the accessory (not shown), trip unit 14 and other electrical components within the circuit breaker 10.

Figure 2:
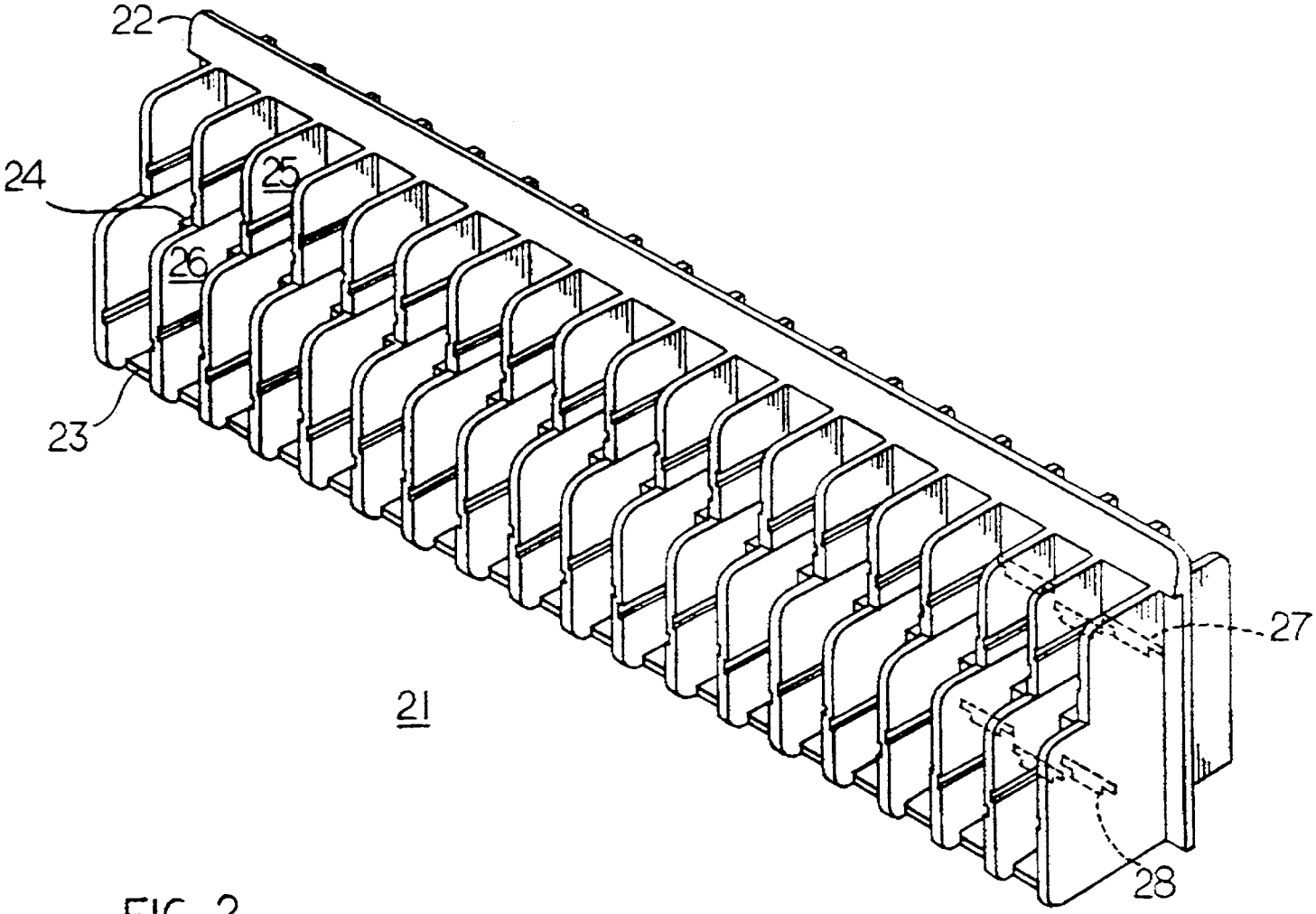
FIG. 2 is a top perspective view of the terminal screw assembly of FIG. 1.

The terminal screw assembly 21, hereinafter "assembly" shown in FIG. 2 is molded from a plastic composition such as Lexan, which is a General Electric Company trademark for a thermoplastic resin. The assembly is configured to include a vertical plate 22, a horizontal plate 23 and an off-set 24 formed midway between the top and bottom of the vertical plate. A plurality of upper compartments 25 and lower compartments 26 are formed within the assembly and include corresponding upper slots 27 and lower slots 28 for insertion of the connectors 30 best seen by now referring to the assembly 21 shown in FIG. 2.

As indicated at A, the insulated wire conductors 32, from the circuit breaker interior, terminate in a connector 29 which includes a threaded opening 30 and a cylindrical crimp 31, which holds the connector to the conductor. A corresponding insulated wire conductor 35, from a remote accessory, terminates in a slotted connector 33 which is held to the conductor by means of a cylindrical crimp 34. With one of the flat connectors 30A inserted through one of the upper slots 27A, as indicated at B, a slotted spade type connector 33A is positioned over the flat plate connector and a terminal screw 36 containing a grip washer 37 is inserted through both connectors and is fastened within the flat plate connector 30A. Since the flat connector is press-fitted within the slot 27A, and part way through vertical plate 22, when both connectors are attached together by means of the terminal screw 36, the connectors are multifunctionally attached together and to the terminal screw assembly, as indicated at C, without requiring any additional fastening means whatsoever.

Figure 3:
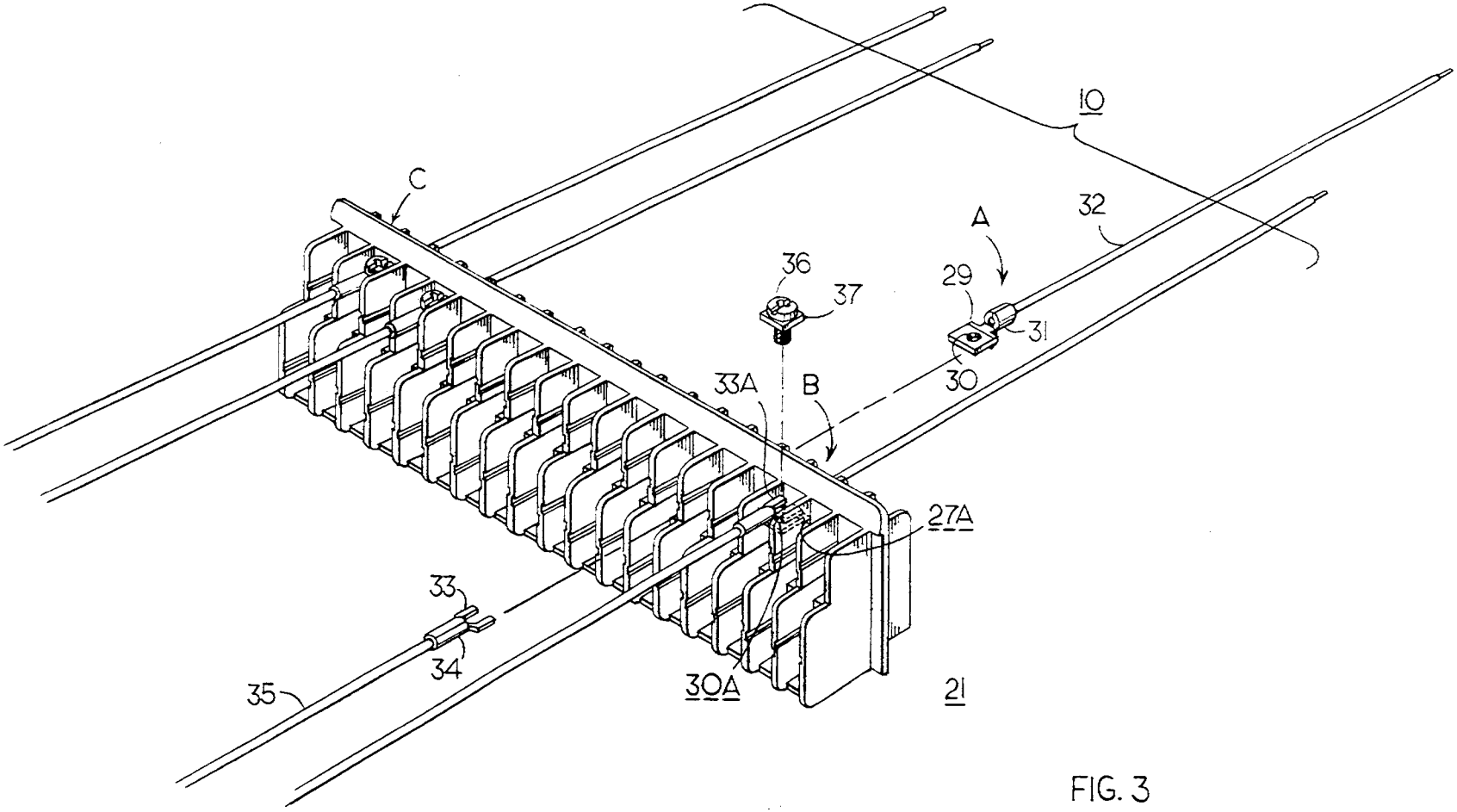
FIG. 3 is a top perspective view of the terminal screw assembly of FIG. 1 with a pair of conductors depicted in isometric projection.
Figure 4:
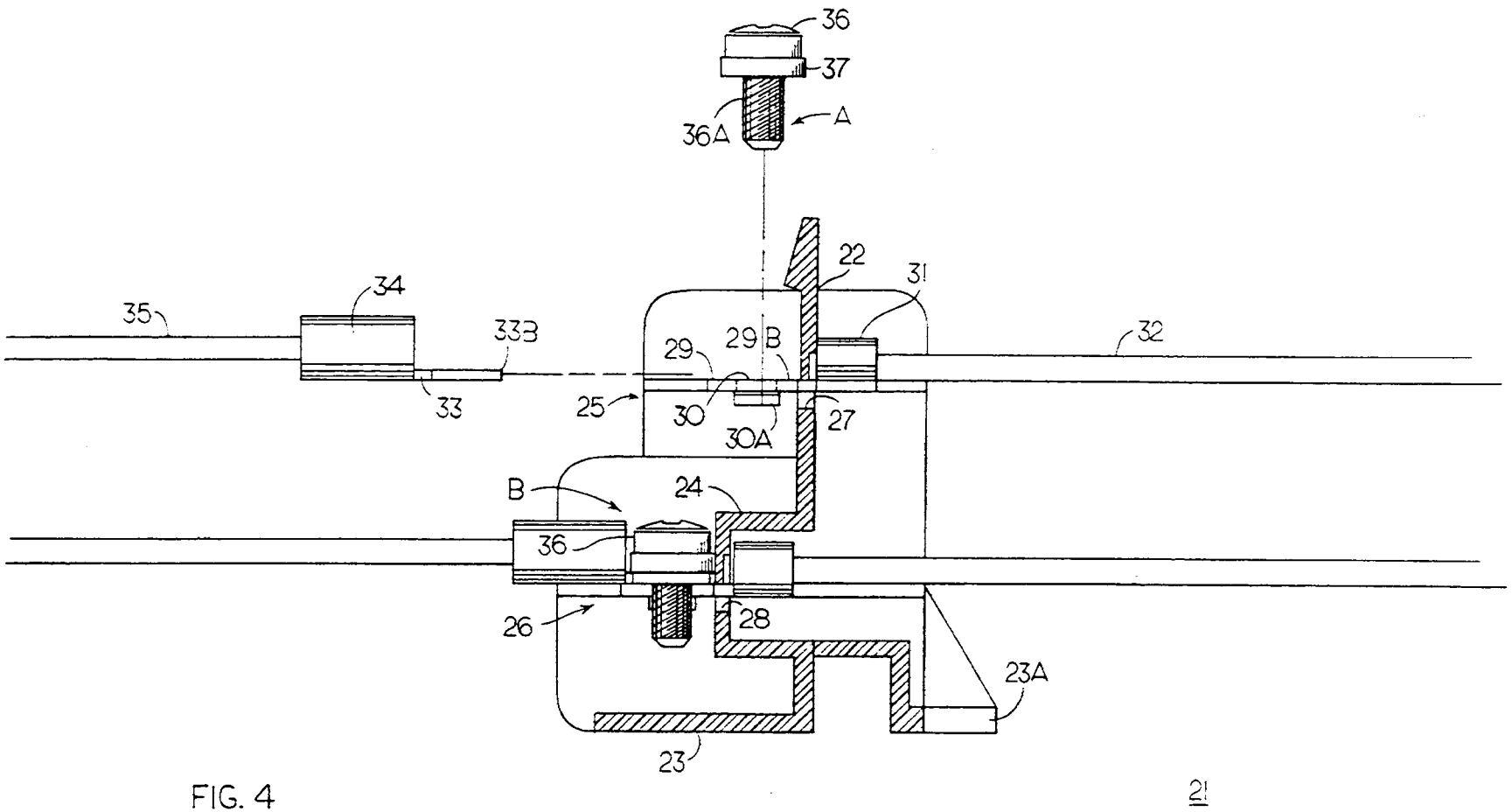
FIG. 4 is a side view of the terminal screw assembly of FIG. 3 in partial section.

The arrangement of the upper compartment 25 over the lower compartment 26 is best seen by now referring jointly to FIGS. 3 and 4. In the arrangement depicted at A in FIG. 4, the cylindrical crimp 31 at the end of the insulated wire conductor 32 leading from the circuit breaker abuts the rear part of the vertical plate 22 and the rear part 30B of the flat plate connector 29 extends within the upper slot 27 in press-fit relation. The threaded lip 29A extends downward from the threaded opening 29 in position to receive the threaded shank 36A and the grip washer 37 on the terminal screw 36. It is noted that the front 33B, of the slotted connector 33 on the insulated wire conductor 35 from the remote accessory, abuts against the side of the vertical divider 22 opposite the cylindrical crimp 31. This feature automatically positions the connectors 30, 33 within the upper compartment 25 for precise alignment of the terminal screw 36. In the arrangement depicted at B, the upper compartment 25 is off-set from the bottom compartment 26 to provide over-surface electrical clearance between the terminal screw 36 in the upper compartment and the terminal screw 36' in the lower compartment, as indicated. To securely affix the assembly 21 within the circuit breaker 10 of FIG. 1, the horizontal plate 23 extends in the rear direction as shown at 23A. The part 23A of the horizontal plate is trapped between the circuit breaker base and the intermediate cover 12 to prevent removal as decribed earlier.

A simple and economical terminal screw assembly for use with electrical equipment such as circuit breakers has been described. The connectors used with the assembly are arranged for attaching two conductor wires by one terminal screw and the conductors are held to the assembly in a press-fit relation.

We claim:

1. A terminal screw assembly comprising:

a plastic molding defining a vertical plate and a horizontal plate defining a plurality of upper and lower compartments integrally formed therein;

a plurality of slots formed within said upper and lower compartments;

a planar connector having a threaded opening arranged therein, said planar connector being attached to a circuit breaker insulated wire conductor by means of a first cylindrical crimp, said first cylindrical crimp abutting against one side of said vertical plate to position said planar connector within one of said upper or lower compartments;

a slotted connector arranged over said planar connector, a front part of said slotted connector abutting against an opposite side of said vertical plate to position said slotted connector within said one of said upper or lower compartments; and a terminal screw extending through said slotted connector and threadingly received within said threaded opening to thereby attach said planar connector to said slotted connector.

2. The terminal screw assembly of claim 1 wherein said planar connector is arranged within one of said slots in press-fit relation.

3. The terminal screw assembly of claim 1 further including a planar washer on said terminal screw.

4. The terminal screw assembly of claim 1 wherein said slotted connector is attached to said circuit breakers conductor by means of a second cylindrical crimp.

5. The terminal screw assembly of claim 1 including an off-set wall intermediate said upper and lower compartments.

6. The terminal screw assembly of claim 1 including a threaded rim extending from said threaded opening.

7. The terminal screw assembly of claim 1 including an extension extending from said horizontal plate, said extension providing means for attachment to a circuit breaker case.

8. A circuit breaker containing internal electrical components comprising:

an insulated base, an intermediate cover and a top cover;

an electronic trip unit contained within said top cover;

an accessory recess within said top cover for receiving an accessory unit;

load straps adapted for connection with associated electrical equipment; and a terminal screw assembly arranged on said intermediate cover for connection between said trip unit and external electrical accessories, said terminal screw assembly including:

a plastic molding defining a vertical plate and a horizontal plate defining a plurality of upper and lower compartments integrally formed therein;

a plurality of slots formed formed within said upper and lower compartments;

a planar connector having a threaded opening and arranged in one of said slots;

a slotted connector arranged over said planar connector; and a terminal screw extending through said slotted connector and threadingly received within said threaded opening to thereby attach said planar connector to said slotted connector.

9. The circuit breaker of claim 8 wherein said planar connector is attached to a circuit breaker insulated wire conductor.

10. The circuit breaker of claim 8 wherein said slotted connector is attached to an accessory insulated wire conductor.

11. The circuit breaker of claim 8 wherein said planar connector is arranged within one of said slots in press-fit relation.

12. The circuit breaker of claim 8 further including a grip washer on said terminal screw.

13. The circuit breaker of claim 9 wherein said planar connector is attached to said circuit breaker conductor by means of a first cylindrical crimp.

14. The circuit breaker of claim 10 wherein said slotted connector is attached to said accessory conductor by means of a second cylindrical crimp.

15. The circuit breaker of claim 8 including an off-set intermediate said upper and lower compartments.

* * * * *